US007317893B2

(12) United States Patent
Maeda

(10) Patent No.: US 7,317,893 B2
(45) Date of Patent: Jan. 8, 2008

(54) HEATING ROLLER, HEATING DEVICE AND IMAGE FORMING APPARATUS

(75) Inventor: Tomohiro Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 214 days.

(21) Appl. No.: 11/143,934

(22) Filed: Jun. 3, 2005

(65) Prior Publication Data

US 2005/0271434 A1 Dec. 8, 2005

(30) Foreign Application Priority Data

Jun. 4, 2004 (JP) ..... 2004-166827

(51) Int. Cl.
*G03G 15/20* (2006.01)

(52) U.S. Cl. ..... 399/333; 399/328

(58) Field of Classification Search ..... 219/216, 219/619; 399/328, 329, 330, 331, 333
See application file for complete search history.

(56) References Cited

U.S. PATENT DOCUMENTS 6,898,409 B2 5/2005 Tsueda et al.
7,006,781 B2 * 2/2006 Imai et al. ..... 399/333
2004/0173603 A1 9/2004 Kinouchi et al.

FOREIGN PATENT DOCUMENTS

JP 06-075493 3/1994
JP 08-129313 5/1996

* cited by examiner

*Primary Examiner*—Hoang Ngo
(74) *Attorney, Agent, or Firm*—Nixon & Vanderhye, P.C.

(57) ABSTRACT

A heating roller is constituted by an elastic roller AA in which an elastic thermal insulation layer is formed, and an endless cylindrical member BB in which a releasing layer is formed on a thin-film base material (heat generating layer), wherein the elastic roller AA and the cylindrical member BB are constituted such that they are separable, and wherein a slight gap is formed between the elastic roller AA and the cylindrical member BB. Then, when a fixing device is started up and the heating roller is rotated, a deflection B1 of the cylindrical member BB caused by the inner diameter difference between the cylindrical member BB and the elastic roller AA is generated on the paper entry side.

25 Claims, 5 Drawing Sheets

HEATING ROLLER, HEATING DEVICE AND IMAGE FORMING APPARATUS

This application claims benefit of JP 2004-166827, filed 4 Jun. 2004, the entire content of which is hereby incorporated by reference.

CROSS REFERENCE TO RELATED APPLICATIONS

This application claims priority under 35 U.S.C. § 119(a) on Patent Application No. 2004-166827 filed in Japan on Jun. 4, 2004, the entire contents of which are hereby incorporated by reference.

BACKGROUND

1. Technical Field

The present invention relates to heating rollers and heating devices that are provided with the rollers, and to image forming apparatuses, and particularly relates to energy saving heating rollers, heating devices and imaging apparatuses that can warm up in a short time, and that can uniformly heat a material that is to be heated.

2. Description of the Related Art

Halogen lamp type fixing devices, which are one type of heating device, and which are constituted by arranging a halogen lamp within a fixing roller made of a hollow metal core of, for example, aluminum, wherein the fixing roller is set to a predetermined temperature by heating the halogen lamp, have conventionally been used as fixing devices. Since halogen lamps have been very easy and inexpensive to incorporate into fixing devices, they have conventionally been appropriate in many image forming apparatuses.

Furthermore, fixing devices have been widely used in recent color image forming apparatuses in recent years, and of these, oil-less color fixing systems in particular have been proposed with the object of, for example, simplifying the apparatuses and increasing the life of the rollers. These oil-less color fixing devices have generally been constituted by forming a thick rubber layer (2 to 3 mm) on the outside of the metal core of the upper and lower rollers, wherein the outermost layer is a releasing layer that has releasability.

However, in halogen lamp-type fixing devices, there has been a problem that the heating startup process is slow, and the warm-up time is long. Consideration has been given here to making the walls of the metal core of the fixing rollers thinner to achieve lower thermal capacity and to shorten the warm-up time. However with this, the deflection of the fixing rollers is too great, the pressure in the central part in the longitudinal direction is weak, and there is a limit to how far the thermal capacity can be reduced because of the risk of poor fixing defects. In particular, with roller-type fixing devices for color image forming apparatuses, there is a thick elastic layer of 1 to 3 mm on the outside portion of the metal core, and so even if the wall thickness of the metal core can be thinned and a reduction in the thermal capacity achieved, the time required for warming-up is still great since the thermal capacity of the elastic layer is large. Furthermore, poor fixing may occur if the thickness of the elastic layer is reduced, and thus there is a limit to how far the thickness of the elastic layer can be thinned down.

In recent years, heating devices in which the warm-up time is reduced in order to achieve energy savings, and energy saving thermal fixing devices, and the like, have been proposed (for example, see JP H8-129313A [referred to below as patent Reference 1] and JP H6-75493A [referred to below as patent Reference 2]).

The heating device disclosed in patent Reference 1 is provided with a heating roller has an internal elastic layer, on the outside of which a heat generating layer of a thickness of 10 to 150 μm is provided, wherein the heat generating layer is heated from the outside. The characteristics of this type are described below.

(1) The heating roller is formed from a thin, heat generating layer, so the thermal capacity can be made small. Thus, the warm-up time can be reduced. (2) The heat generating layer has an appropriate stiffness, and is fixed onto the elastic layer that is fixed on the metal core, so that it has superior durability. (3) There is an increased degree of freedom for selecting the width of the nip created due to the elasticity of the internal portion of the heating roller and the elasticity of the pressuring roller, so that the image forming apparatus is capable of high speed. (4) The pressuring deflection of the axles of the pressuring rollers is dampened by the elasticity of the inner portion of the heating roller, and a uniform nip width can be maintained in the longitudinal direction. Thus, the load on the heated material, such as transfer material is uniform, and problems such as waviness can be eliminated. (5) The appropriate stiffness of the heat generating layer acts to form a uniform nip width in the longitudinal direction. Thus, it is possible to prevent the heated material from curling due to the curvature of the heating roller at a nip portion that is flat by setting the surface hardness of the pressuring member to be similar to or greater than the surface hardness of the heating roller.

Furthermore, in patent Reference 2, there is disclosed a heating fixing device made of a heating roller containing an internal heater; and a flexible, deformable thin-walled tube-shaped body that is formed with thin walls and in a tube shape, and whose inner diameter is larger than the outer diameter of the heating roller, wherein the thin-walled tube-shaped body fits around the circumference of the heating roller in a free manner. With this type, since the apparent contact area (nip width) between the heating roller and the pressuring roller increases due to the presence of the thin-walled tube-shaped body, it is possible to form an apparently wide nip width even by the use of comparatively small diameter heating rollers and pressuring rollers by fitting movably the thin-walled tube-shaped body around the heating roller and creating contact with the pressuring roller. Thus it is possible to achieve a heating fixing device that is compact, and that consumes less electrical power.

However, in the heating device in the patent Document 1 described above, although it is possible to shorten the warm-up time to less than that when using a conventional halogen lamp, there is a problem in the loss of warm-up time since some of the heat that is generated in the heat generating layer escapes to the inside of the elastic layer.

Furthermore, in accordance with the above noted configuration, when paper containing an unfixed image passes between the rollers, the recording paper winds up onto the heating roller and it is exceedingly difficult to obtain releasability. In particular, when fixing unfixed color images onto thin paper, it is necessary to fix a maximum of four toner layers on top of each other, and the problem of releasability becomes more acute.

In the heating device according to the above-noted patent Reference 2, since the internal diameter of the thin-walled tube-shaped body is larger than the external diameter of the heating roller, there is an air layer between the thin-walled body and the heating roller. Thus there is a large thermal insulating effect and this is also advantageous to the warm-up time. However, since it is necessary to heat the roller from the inside, although originally it has been desirable to only heat the thin-walled tube-shaped body, there is a problem of very poor efficiency because the internal heating roller, which it is not necessary to heat, is heated, and the thin-walled tube-shaped body is indirectly heated using that conducted heat.

SUMMARY

The present invention was created to solve these problems, and it is an object thereof to provide an energy saving heating roller, and a heating device and an image forming apparatus provided with the heating roller, that achieves a reduction in warm-up time by efficiently conducting generated heat to the heating roller surface, as well as that is capable of ensuring favorable releasability even for unfixed images, the releasability of whose color images is difficult to ensure.

In order to achieve the object noted above, the heating roller provided with an elastic roller having an elastic thermal insulation layer above a metal core, and a flexible tube-shaped member in which at least a releasing layer is formed above a thin-film base material that generates heat or is heated, wherein the elastic roller and the tube-shaped member are provided such that they are separable, and wherein a slight gap is formed between the elastic roller and the tube-shaped member.

In order that the heat of the tube-shaped member that is heated is conducted only toward the outside of the heating roller, an elastic thermal insulation layer that has thermal insulating properties is provided on the inside of the tube-shaped member. However, even if the elastic thermal insulation layer is provided, if the inner surface of the tube-shape member is in close contact with the elastic thermal insulation layer, then the heat is also lost to the inner portion. Thus, in an example embodiment, the elastic roller on the inside and the tube-shaped member are constituted so as to be separable, and a gap (air layer) is formed between the tube-shaped member and the elastic roller. By providing a gap (air layer) in this way, the thermal insulating properties are greater than if they were in close contact. Thus, it is possible to heat the surface of the heating roller to a predetermined temperature in a short warm-up time due to this thermal insulating effect.

Furthermore, with the heating roller of an example embodiment, it is preferable that an inner diameter difference d(=Ø2−Ø1) between the outer diameter of the elastic roller (Ø1) and the inner diameter of the tube-shaped member (Ø2) satisfies the expression:

$$0<d(=Ø2-Ø1)<2 \text{ mm}.$$

In this case, while driving the heating roller, an air layer is formed in at least part of a region between the elastic roller and the tube-shaped member, due to the inner diameter difference, and the tube-shaped member warps.

For example, if the inner diameter difference is 0 or less, then since the self releasability of the paper is not favorable, aiding members are necessary to forcibly release the paper. However, if the inner diameter difference is in the range described above, the thermal insulating effect described above increases, and at the same time, self releasability of the paper is improved. This is because the deflection (air layer) of the tube-shaped member is only generated on the paper feed side, as shown in FIG. 4, when the fixing device is operated to rotate the heating roller, and the curvature in the vicinity of the exit of the nip can be maintained.

On the other hand, if the inner diameter difference is 2 mm or more, then because the tube-shaped member is not stiff, when the fixing device is operated to rotate the heating roller, sagging of the tube-shaped member occurs in the vicinity of the nip (paper feed side and paper discharge side), as shown in FIG. 5. Thus, the instant the paper that is carrying the unfixed toner image (recording paper) exits the nip region, the paper winds up on the heating roller without releasing, because of the sagging of the tube-shaped member, and thus paper releasability worsens.

Describing this in further detail, if the inner diameter difference is 0<d<2 mm when the fixing device is operated to rotate the heating roller, then the tube-shaped member only sags on the paper feed side while the curvature in the vicinity of the paper discharge side is maintained, and releasability is favorable. On the other hand, sagging is generated on both the paper feed side and the paper discharge side when the inner diameter difference is 2 mm or greater, as shown in FIG. 5, and releasability worsens.

With the heating roller of an example embodiment, a hardness differential between the surface hardness of the tube-shaped member as the heating roller, and the surface hardness of the elastic roller is set to a hardness differential such that the shape of a nip portion, which is the contacting portion between the heating roller and a pressuring member that is pressed against the heating roller, has a shape that faces downward. In this case, a base material that constitutes the tube-shaped member is based on resin. Describing in still more detail, it is preferable that the surface hardness differential t3(=t1−t2) between the surface hardness t1 of the heating roller and the surface hardness t2 of the elastic roller satisfy the expression:

$$0° \leqq t3 < 50°$$

as measured by an Asker C durometer.

That is, by reducing the surface hardness of the heating roller as much as possible, it is also possible to make the shape of the nip, which is formed by pressing on the pressuring member, point downwards. Furthermore, the surface hardness of the heating roller is greatly influenced by the surface hardness of the inner elastic thermal insulation layer. However, if the surface hardness differential between the surface hardness of the heating roller and the elastic roller is 50° or greater, then since the tube-shaped member itself will be too hard, even if the inner elastic thermal insulation layer has low hardness, as for the shape of the nip, the downward facing nip will weaken because the surface hardness of the heating roller will increase, and it becomes difficult to maintain the releasability of the paper.

Furthermore, a heating device of an example embodiment is provided with at least a heating rotating member that is constituted by the heating roller having the above-noted configuration, a pressuring member that is pressed onto the heating rotating member, and heating means for externally heating the heating rotating member, wherein an unfixed toner image is fixed in a nip portion that is formed by the heating rotating member and the pressuring member being pressed together. Thus, since only the surface layer of the heating rotating member is heated, heating can be performed efficiently by providing the heating means on the exterior of the heating rotating member.

Furthermore, with the heating device of an example embodiment, the relationship of the surface hardness of the elastic thermal insulation layer, which constitutes the heating rotating member, to the surface hardness of the pressuring member, is set to a relationship such that the shape of the nip portion is a shape that faces downward. More specifically, the surface hardness of the elastic thermal insulation layer is set lower than the surface hardness of the pressuring member. By such a surface hardness relationship, paper releasability (particularly, releasability when four toner layers, such as unfixed color toner images, are layered) is favorable since the nip shape faces downward.

With the heating device of an example embodiment, it is preferable that the tube-shaped member is made from at least three layers, being a heat generating layer, an elastic layer, and a releasing layer. That is to say, when fixing unfixed color images, it is necessary to fix a maximum of four layered toner layers, and since there are portions that have a layer of toner, and portions that don't, depending on the location, there may be bumps and depressions in the toner surface. Furthermore, since there may be large bumps and depressions in the paper, depending on the type of paper itself in order to fix the toner following these bumps and depressions, it is necessary to configure the surface of the releasing layer such that it flexibly surrounds the toner. Thus, in an example embodiment, the heating device has a structure in which there is an elastic layer between the releasing layer and the heat generating layer.

With the heating device of an example embodiment, a release aiding member for aiding the release of recording paper is arranged on the paper discharge side of the heating rotating member, proximate to the heating rotating member. Thus, by arranging the release aiding member in a position proximate to the heating roller (heating rotating member), the non-offset region can be expanded since paper that is discharged with a tendency to wind up on the heating roller can be forcibly separated by the release aiding member. Furthermore, since the release aiding member does not contact the heating roller, there will be no scratches on the surface of the heating roller due to the release aiding member during at the time of release, and the durability of the heating roller can be ensured. As opposed to this, the fixing region will not increase with a heating roller in which the outer diameter of the elastic roller and the inner diameter of the tube-shaped member cannot be maintained at a predetermined amount (conventional heating roller), even with the use of the release aiding member. That is to say, with conventional heating rollers, even if an attempt is made to forcibly separate paper that has a tendency to wind up, it is not possible to catch the paper with a release aiding member that is provided in a proximate position, and thus the paper winds up. If the paper is to be forcibly separated from the surface, it is necessary for the release aiding member to make contact with the heating roller.

With the heating device of an example embodiment, drift prevention guide members are provided on both ends of the heating rotating member, for preventing the tube-shaped member from meandering. Since the tube-shaped member and the elastic roller are rotated by rubbing together, the tube-shaped member drifts toward the side in the direction of the member axis due to variations in the load and variations in the circumference. The drift of the tube-shaped member can be controlled by providing a drift prevention guide member on the edge of the tube-shaped member in order to prevent drift.

Particularly, if the inner diameter difference is in the range described above ($0<d$ ($=Ø2-Ø1$)$<2$), then the outer diameter of the drift prevention guide members can be controlled to substantially the same as the outer diameter of the heating roller. On the other hand, if the inner diameter difference exceeds 2 mm, then it becomes difficult to suppress the meandering of the tube-shaped member.

With the heating device of an example embodiment, it is preferable that the heating means is induction heating means that applies an alternating magnetic field to the heating rotating member to generate an induction electric current. Although lamp-type heating using lamps such as halogen lamps, and induction-type heating that uses heaters such as ceramic heaters or induction coils may be used as the heating means, it is necessary to arrange the heating means so as to cover (about half a circumference) the heating rotating member in order to uniformly heat the heating rotating member in a short time. These conditions are fulfilled when using induction-type heating, and realization of the heating device is facilitated.

It should be noted that images having favorable quality can be formed over a wide range of heating device temperatures, by mounting a heating device of the above-noted configurations into an image forming device.

With the heating roller of an example embodiment, and the heating device that is provided with the heating roller, since the inner elastic roller and the tube-shaped member are configured so as to be separable, an air layer can be formed in at least part of a region between the tube-shaped member and the elastic roller when driving the heating roller, and the thermal insulating effect is greater than with a conventional roller in which the elastic roller and the tube-shaped member are in close contact. Thus it is possible to heat the surface of the heating roller to a predetermined temperature in a short warm-up time, due to this thermal insulating effect.

Furthermore, with the image forming apparatus of an example embodiment, by providing such a heating device, it is possible to form images having favorable quality over a wide range of temperature settings of the heating device.

DESCRIPTION OF PREFERRED EMBODIMENTS

An example embodiment is described below with reference to the drawings.

<Description of an Example Embodiment of an Overall Image Forming Device>

Figure 1:
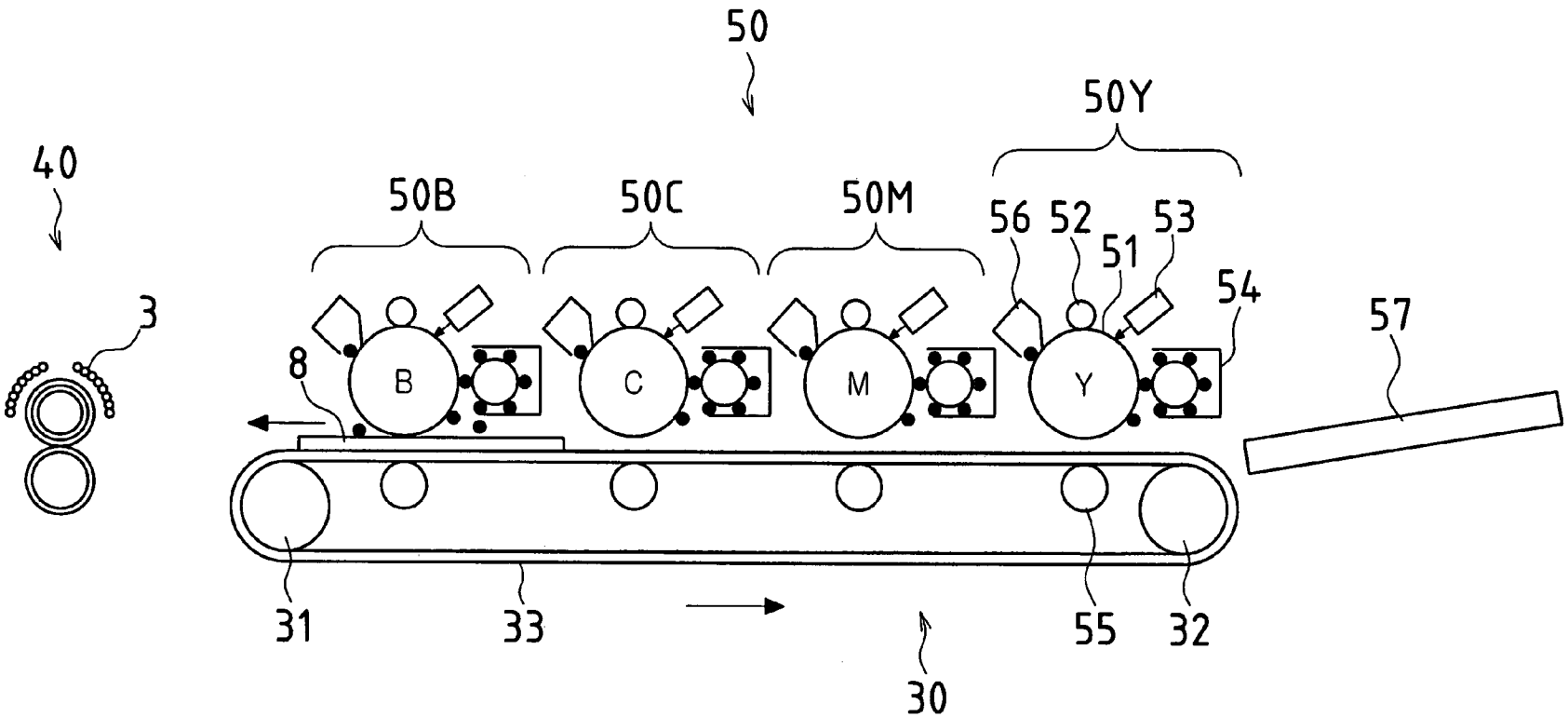
FIG. 1 is a cross-sectional overview showing a configuration of principal portions of an image forming apparatus that is provided with a heating device in which the heating roller of an example embodiment is applied.

FIG. 1 shows a configuration of the principal elements of an image forming apparatus that is provided with a heating device in which an example embodiment of a heating roller of the present invention is applied. However, FIG. 1 shows the internal structure of a dry electrophotgraphic color image forming apparatus.

The color image forming apparatus is a device for forming multi-color or single color images onto a predetermined piece of paper (recording paper), based on image data, for example, that is transmitted from terminals on a network or the like, wherein the color image forming apparatus is provided with a visible image forming unit 50 (50Y, 50M, 50C and 50B), recording paper carrying means 30, a fixing device (heating device) 40, and a supply tray 57.

That is to say, in the color image forming apparatus four visible image forming units 50Y, 50M, 50C and 50B respectively corresponding to the colors yellow (Y), magenta (M), cyan (C) and black (B) are arranged side by side. That is to say, the visible image forming unit 50Y forms images using yellow (Y) toner, the visible image forming unit 50M forms images using magenta (M) toner, the visible image forming unit 50C forms images using cyan (C) toner, and the visible image forming unit 50B forms images using black (B) toner. For a more specific arrangement, the four visible image forming units 50Y, 50M, 50C and 50B are arranged along the carrying path of the recording paper that connects the supply tray 57 of the recording paper 8 to the fixing device 40. This is what is known as a tandem-type arrangement.

Each of the visible image forming units 50Y, 50M, 50C and 50B have substantially the same configuration. That is to say, each is provided with a charger 52, laser light irradiating means 53, a developer 54, a transfer roller 55 and a cleaner unit 56 arranged around a photosensitive drum 51 to transfer multiple layers of toner onto the recording paper 8 that is carried.

The photo sensitive drum 51 supports the image that is to be formed. The charger 52 charges the surface of the photosensitive drum 51 to a uniform electric charge. The laser light irradiating means 53 exposes light onto the surface of the photosensitive drum 51, which was charged by the charger 52, in accordance with image data input into the image forming apparatus, and forms a latent electrostatic image on the surface of the photosensitive drum 51. The developer 52 uses color toner to develop the electrostatic latent image that was formed on the surface of the photosensitive drum 51. The transfer roller 55 contains an applied bias voltage whose polarity is opposite to that of the toner, and it transfers the toner image that was formed, onto the recording paper 8 that is carried by the recording paper carrying means, which is described below. The drum cleaner unit 56 removes and collects the residual toner remaining on the surface of the photosensitive drum 51 after developing the image at the developer 52 and after transferring the image formed on the photosensitive drum 51. Transferral of the toner image to such recording paper 8 is repeated four times for the four colors.

The recording paper carrying means 30 is made from a drive roller 31, an idling roller 32, and a carrying belt 33, and carries the recording paper 8 such that toner images are formed on the recording paper 8 at the visible image forming units 50. The drive roller 31 and the idling roller 32 suspend an endless carrying belt 33. The drive roller 31 is controlled to, and rotates at, a predetermined circumferential velocity, and rotates the endless carrying belt 33. The carrying belt 33 generates static electricity on its outer surface, and carries the recording paper 8 while electrostatically bonding with the recording paper 8.

After transferably receiving the toner image while being carried by the carrying belt 33 in this way, the recording paper 8 is released from the carrying belt 33 by the curvature of the drive roller 31, and is transferred to the fixing device 40. The fixing device 40 forms a fixed image by melting the toner and fixing it to the recording paper, by applying suitable heat and pressure to the recording image 8.

<Description of an Example Embodiment of the Fixing Device (Heating Device)>

Figure 2:
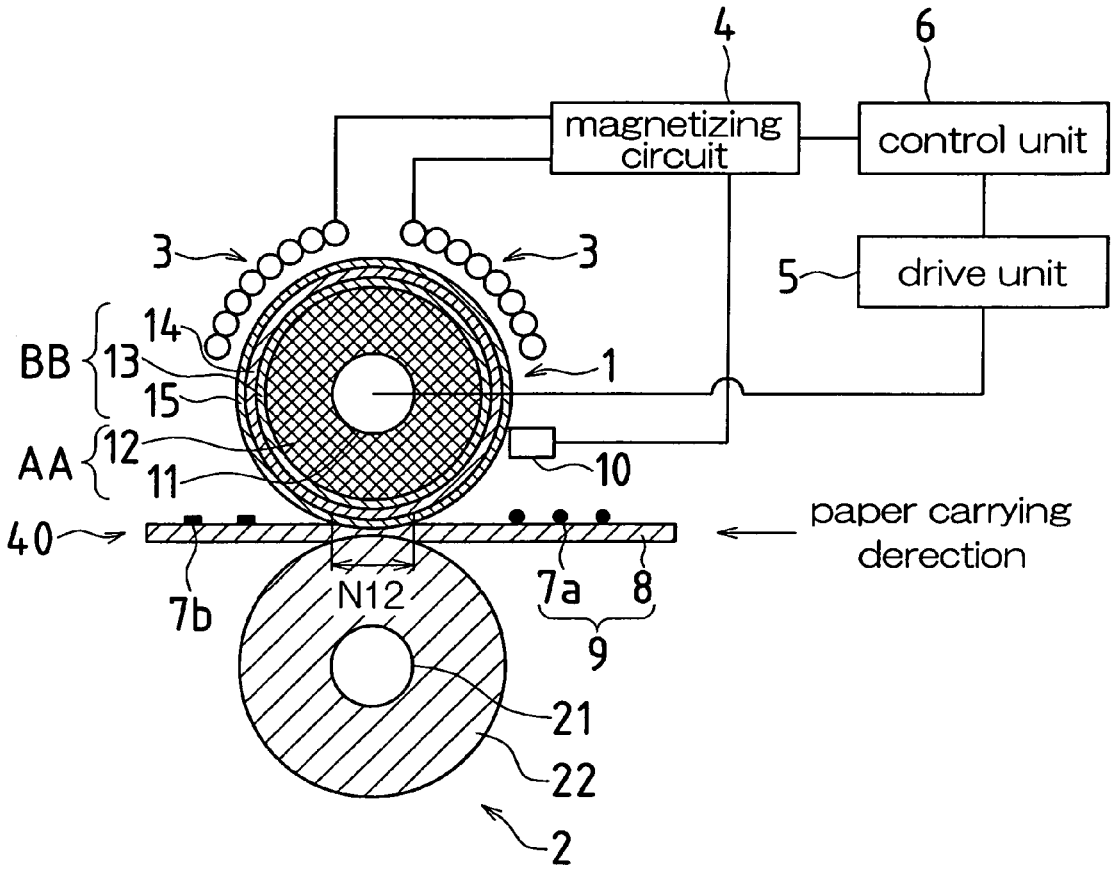
FIG. 2 is a cross-sectional overview showing a more detailed configuration of the fixing device (heating device).

FIG. 2 shows the configuration of the fixing device (heating device) 40 in more detail.

The fixing device 40 is heated by induction heating. Lamp heating using lamps such as halogen lamps, and induction heating using induction coils may be used as heating means, however in order to fix the image in a short time and with uniform heating, it is preferable to use an induction heating method using induction coils, such as are shown below.

That is to say, the fixing device 40 is constituted by a heating roller (heating member) 1, a pressuring roller (pressuring member) 2, a magnetic field generating unit 3, a magnetizing circuit 4, a drive unit 5 and a control unit 6. The fixing device 40 melts toner 7*a* and presses it onto the recording paper 8 to fix the image to the recording paper 8 by passing material 9 to be heated, which is the recording paper 8 on whose surface the unfixed toner 7*a* is attached, through a contact portion (nip portion) N12 between the given heating roller 1, which has been heated to a predetermined temperature, and the pressuring roller 2. It should be noted that after fixing, toner 7*b* has been melted into the recording paper and it becomes glossy.

<Description of an Example Embodiment of the Heating Roller 1>

Firstly, the heating roller 1 is described in detail.

The heating roller 1 is constituted by an elastic roller AA in which an elastic thermal insulation layer 12 is formed on a metal core 11, and a tube-shaped member (referred to below as a cylindrical member) BB that is endless and is flexible, onto whose thin film base material (heat generating layer) 13, a releasing layer 15 is laminated. The elastic roller AA and the cylindrical portion BB are configured so as to be detachable.

Thus, although the cylindrical member BB is configured such that the releasing layer 15 is laminated onto the heat generating layer 13, gloss inconsistencies occur in the fixed image when color images are fixed, and thus an elastic layer may be provided between the heat generating layer 13 and the releasing layer 15. In the present embodiment, an elastic layer 14 is provided.

<Description of an Example Embodiment of the Elastic Roller AA>

The elastic roller AA is described in detail next.

A hollow aluminum cylinder that has an outer diameter of 28 mm is used as the metal core 11 of the elastic roller AA. The material and shape are not limited to these, and the metal core 11 may be made from iron, for example. Furthermore, the shape of the metal core 11 may also be such that the center is not hollow (for example, it may also be solid), however heat radiation from the metal core 11 is suppressed, so a hollow type is desirable.

The elastic thermal insulation layer 12 uses a 5.5 mm thick silicone sponge foam that is both thermally insulating and heat resistant. In order that the elastic roller AA and the cylindrical member BB are separable, they are constituted such that the outer diameter of the elastic roller AA is 1 mm less than the inside diameter of the cylindrical member BB. The surface hardness at this time is 25° as measured by an Asker C durometer. However, if the surface hardness is 10° or less, then there may be considerable changes in the surface hardness of the roller according to a durability test, it is difficult to maintain the initial surface hardness, and thus it is necessary that the surface hardness is at least 10° or greater.

The elastic thermal insulation layer 12 gives flexibility to the surface of the heating roller 1, creates a distortion in the nip portion N12 formed between the heating roller 1 and the pressuring roller 2, and can further increase the width of the nip portion N12 (to a wide nip). As well, since the elastic thermal insulation layer 12 is thermally insulating, the efficiency of thermal conduction increases because the elastic thermal insulation layer 12 prevents heat from the heat generating layer 13 from being conducted in the direction opposite to the direction it should be, that is to say, in the direction from the heat generating layer 13 away from the surface. In particular, the outer diameter of the elastic thermal insulation layer 12 is smaller than the inner diameter of the cylindrical member BB, and so since there is no close contact between the internal surface of the cylindrical member BB and the external surface of the elastic roller AA in the circumferential direction other than at the nip portion N12, it is thus possible to severely reduce the amount of heat generated by the heat generating layer 13 that is conducted to the elastic thermal insulation layer 12.

Furthermore, the thickness of the elastic thermal insulation layer 12 does not contribute to increasing the thermal capacity of the heating roller 1, and thus it is possible to adjust its pliability without increasing the thermal capacity as a result of adjusting the thickness. The outer diameter of the elastic roller formed in this way is 39.0 mm.

An example embodiment of means for measuring the outer diameter of the elastic roller AA is hereby described.

A laser scanning micrometer (manufactured by Mitutoyo Corporation) is used in this case as an apparatus for measuring the outer diameter of the elastic roller AA. This is a high precision laser measurement system for non-contact measurement of the outer diameter dimensions of the elastic roller AA by a laser beam that is scanned at high speed (the instrument can read in to 0.001 mm, and the measurement accuracy is ±0.001 mm).

<Description of an Example Embodiment of the Cylindrical Member BB>

<Description of the Cylindrical Member BB>

The cylindrical member BB is described next in further detail.

The heat generating layer 13, which is the base material of the cylindrical member BB, employs a resin base (or a rubber base) in which metallic powder has been dispersed. More specifically, the heat generating layer employs an 80 μm thick polyimide resin that is heat resistant, as the base material, into which metallic microparticles of silver, for example, are dispersed. This is a heat generating body that generates heat by the application of an alternating magnetic field. Provided that such induction heating is possible, there is no limitation on the material or the thickness of the heat generating layer 13. Electrically conductive materials that are magnetic, such as iron and SUS 430 stainless steel, may be used as the material of the heat generating layer 13, however silicon steel plate or magnetic steel plate in which the relative magnetic permeability is high, and nickel steel or the like is particularly preferable. Furthermore, even with non-magnetic electrically conductive materials, inductive heating is possible provided that the material has a high resistance value, such as SUS 304 stainless steel, and thus these may be used.

Moreover, if using a base material that is resin-based as the heat generating layer 13, then this is preferably a thermally resistant resin such as polyimide or polyimide amide. Furthermore, copper, aluminium, nickel, iron and stainless steel may be used as the metal micro-particle material that is dispersed in the resin. The heat generating layer may also be formed by methods other than this, such as forming a thin metal film onto the resin base material by vapour deposition or metal plating.

As for the thickness of the heat generating layer 13, it is preferable to thin this wall to a thickness of 10 μm or more to 150 μm or less, in order to shorten the time it takes for the temperature of the surface of the heating roller 1 to start to increase. If the thickness is less than 10 μm, then the durability of the heat generating layer 13 is insufficient, and there is a risk of breakage while rotating. On the other hand, if the thickness is greater than 150 μm, then the thermal capacity is large, which increases the warm-up time.

When the heated material 9 is pressed against the heating roller 1 by the pressuring roller 2, the elastic layer 14 deforms the releasing layer 15 to follow the bumps and depressions in the surface of the heated material 9 such that the heat from the heating roller 1 is uniformly conducted. When fixing the unfixed color image, it is necessary to layer and fix a maximum of four toner layers, and since there are portions that have a layer of toner, and portions that don't, depending on the location, there may be bumps and depressions in the toner surface. Furthermore, since there may be large bumps and depressions in the paper, depending on the type of recording paper itself, in order to fix the toner following these bumps and depressions, it is necessary that the surface of the releasing layer flexibly surrounds the toner. Thus, it is necessary to have the elastic layer 14 between the releasing layer 15 and the heat generating layer 13. In the present embodiment, the elastic layer 14 employs silicone rubber having a thickness of 250 μm and a rubber hardness of 20° (JIS-A), however these are not limitations.

The material of the elastic layer 14 may be any material, as long as it has superior thermal resistance and rubber elasticity, and, for example, silicone rubber, fluorine rubber, and fluoro-silicone rubber can be used. Of these, it is particularly desirable to use silicone rubber, which has superior rubber elasticity.

The thickness of the elastic layer 14 is preferably set to 50 μm or above, and to 400 μm or less. If the thickness of the elastic layer 14 is greater than 400 μm, there is an increase in the warm-up time due to the increase in the thermal capacity of the heating material itself, and more energy is required for heating. Furthermore, when the thickness is less than 50 μm, gloss inconsistencies occur because the releasing layer 15 is not able to follow the bumps and depressions of the toner surface, and thus it is not possible to uniformly melt the surface.

The material of the releasing layer 15 may be any material, as long as it has superior thermal resistance and durability, and that the adhesive force with the toner is weak. Fluorine based materials such as PFA (a co-polymer of tetra fluoroethylene and perfluoroalkyl vinyl ether) or PTFE (polytetrafluoroethylene) may be used. In the present embodiment, PFA having a thickness of about 20 μm was used.

The surface hardness of the cylindrical member BB that is configured in this way is 65° (Asker C hardness), and the inner diameter is 40.0 mm.

An example embodiment of means for measuring the internal diameter of the cylindrical member BB are hereby described.

As a method for measuring the internal diameter, the total thickness of the cylindrical member BB is measured by digital micrometer (the instrument can read in to 0.001 mm, and the measurement accuracy is ±0.001 mm). After this, the laser scanning micrometer described above is used to measure the outside diameter of the cylindrical member BB, and the inside diameter of the cylindrical member BB is calculated by subtracting the total thickness that was measured previously. Furthermore, as another method, there is also a method in which a cylindrically-shaped taper gauge is inserted into the cylindrical member BB, and the internal diameter read out visually (reading-out is possible to 0.1 mm, and the measurement accuracy is ±0.05 mm).

The cylindrical member BB is thus described above.

The cylindrical member BB and the elastic roller AA configured as noted above are driven to rotate by the above-noted drive unit 5.

On the other hand, since the cylindrical member BB and the elastic roller AA are rotated while rubbing together, the cylindrical member BB drifts toward the side in the belt axial direction due to variations in the load and variations in the circumference.

Figure 6:
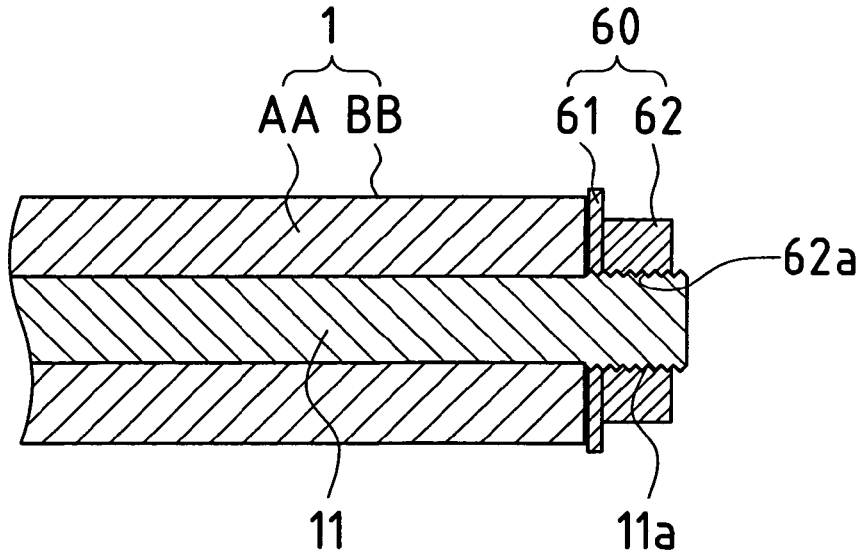
FIG. 6 is a cross-sectional overview showing a condition in which a drift prevention guiding member is attached to the heating roller.

Thus, in the present embodiment, drift prevention guide members 60 are provided on both ends of the heating roller 1 as shown in FIG. 6 (only the right end is shown in FIG. 6) in order to prevent the cylindrical member BB from meandering.

The drift prevention guide members 60 are constituted by flange portions 61 that have outer diameters that are a similar or slightly larger diameter than the outer diameter of the heating roller 1, and metal core fixing portions 62 that protrude to the outside of the flange portions 61. The metal core fixing portion 62 are formed in a columnar shape, and female screw apertures 62*a* are provided in their centers. On the other hand, male screw portions 11*a* are formed on the circumferential faces of the end portions of the metal core 11, and the flange portions 61 are fixed into close contact with the end faces of the heating roller 1 by screwing the male screw portions 11*a* into the female screw apertures 62*a* of the metal core fixing portions 62. However, provided that the drift prevention guide members 60 have a structure in which the metal core fixing portions 62 and the metal core 11 are securely fixed, it is not necessarily required to have a structure in which the female screw apertures 62*a* and the male screw portions 11*a* screw together, they can be securely fixed by forcible insertion. Thus, the drift prevention guide members 60 rotate with the heating roller 1 in a condition in which movement in the axial direction of the metal core 11 is regulated. Thus, even if the cylindrical member BB meanders (moves in the axial direction of the metal core 11), and contacts the flange portions 61, meandering of the cylindrical member BB can be prevented because the flange portions 61 do not move.

<Description of an Example Embodiment of the Pressuring Roller 2>

The pressuring roller 2 is described next in further detail.

The pressuring roller 2 is provided with an elastic layer 22 laminated onto a metal core 21. The pressuring roller 2 is pressed against the heating roller 1 by the action of an unshown elastic member (such as a spring), and creates the contact nip portion N12 between itself and the heating roller 1. Then, when the recording paper 8 passes through the nip portion N12, the pressuring roller 2 presses the recording paper 8 against the heating roller 1, and performs the role of ensuring that the heat is suitably transferred to the recording paper 8 and the toner 7.

The core metal 21 of the pressuring roller 2 is made of iron in the present embodiment, and is made using a piece that has a diameter of 20.0 mm. However there is no limitation on the material and the size, and it may be made of a material such as stainless steel or aluminium.

The elastic layer 22 is a layer for the purpose of applying an even pressure to the recording paper 8, and in the present embodiment, thermally resistant silicone rubber having a thickness of 5 mm is used. However, provided that the material is one that can fulfill these functions, there is no limitation on the material and the thickness.

The layers of the pressuring roller 2 are in strong, close contact, and the outer diameter of the pressuring roller 2 is 30.0 mm. It should be noted that as with the releasing layer 15 of the heating roller 1, a releasing layer made of PFA or PTFE may also be formed on the surface of the pressuring roller 2 for the purpose of preventing adhesion of the toner 7. The surface hardness of the heating roller 2 that is created in this way was 80° (Asker C hardness). Here, it is preferable that the surface hardness of the pressuring roller 2 is higher than the surface hardness of the elastic thermal insulation layer 12 of the heating roller 1. This is because, since it is possible to direct the shape of the nip portion N12, which is formed by pressing the heating roller 1 together with the pressuring roller 2, downwards, when fixing color images, self release is facilitated (that is to say, the paper releases from the roller without requiring means for aiding forcible release, such as release prongs), and release is possible without substantially relying on release prongs and the like. On the other hand, when the surface hardness of the pressuring roller 2 is lower than the surface hardness of the elastic thermal insulation layer 12 of the heating roller 1, since the shape of the nip portion is directed upwards, the recording paper 8 that is discharged from the nip portion N12 is discharged along the surface of the heating roller 1, and self-release is insufficient.

<Description of an Example Embodiment of the Magnetic Field Generating Unit 3>

The magnetic field generating unit 3 is described next.

The magnetic field generating unit 3 that generates heat by applying an alternating electric field to the heating roller 1 is constituted by induction coils, and these are configured so as to enclose about half the circumference of the circumferential portion of the heating roll 1. With such a configuration, there is curvature in the induction coil, and the production of eddy current is large since the magnetic flux is concentrated in the center of the circle having a curvature of the induction coils. Thus, since the amount of heat generated by the heat generating layer 13 is large, the surface temperature of the heating roller 1 rapidly increases, and it is possible to obtain a reduction in the warm-up time.

For the induction coils in the present embodiment, aluminium wire is used out of consideration to thermal resistance, and the surface thereof is covered with an insulating layer (such as an oxide film). However, the induction coils may employ copper wire, or compound wire members based on copper, and they may also be litz wire (enamel wires that are braided into a single wire). It should be noted that with any wire material, in order to suppress joule losses in the induction coils, its is preferable that the total resistance value of the induction coils is 0.5 Ω or less, and it is desirable that the total resistance value is 0.1 Ω or less. Furthermore, it is possible to arrange a single induction coil, or to arrange a plurality of coils depending on the size of the recording paper that is to be fixed.

The magnetizing circuit 4 is for running a high frequency current through the induction coils of the magnetic field generating unit 3, and thus generating an alternating magnetic field to apply to the heating roller 1. The heat generating layer 13 of the heating roller 1 generates heat when the alternating magnetic field is applied to the heating roller 1.

The control unit 6 is constituted by a CPU (central processing unit) and the like, and this controls the high frequency electric current that runs through the magnetizing circuits 4. Thus, the temperature of the heating roller 1 can be controlled to a predetermined temperature. It should be noted that a thermistor 10 is arranged at the periphery of the heating roller 1 in the vicinity of the entry to the nip portion, and this is set so as to detect the surface temperature of the heating roller 1 and to output a monitoring signal. The control unit 6 controls the magnetizing circuit 4 in accordance with the detecting signal from the thermistor 10, and controls the temperature of the heating roller 1 to a predetermined temperature.

The drive unit 5 drives to rotate the heating roller 1, and while carrying the recording paper 8 on which the unfixed toner 7*a* image is carried, the toner 7*a* is fixed to the recording paper 8 by the application of heat and pressure generated by the drive portion 5 rotating the heating roller 1 to carry the recording paper 8. It should be noted that the operation of the drive unit 5 is controlled by the control unit 6.

WORKING EXAMPLE 1

An experiment was performed to evaluate the releasability of a fixing device having the above-noted configuration, wherein the conditions of the cylindrical member BB were the same, and wherein only the outer diameter of the elastic roller AA was altered from 38.0 to 40.0 mm.

Evaluation of the releasability was carried out by passing unfixed image samples, which are described next, through the fixing device. Samples that released without problem from the discharge side (that is, released without winding up on the fixing roller (heating roller) 1) were rated "A", those that discharged with a tendency to wind up on the fixing roller (heating roller) 1, or in which image defects such as toner peeling occurred were rated "B", those that wound up on the fixing roller (heating roller) 1 were rated "F", and samples that released without problem but where the image was hot offset (a phenomenon in which a part of the toner from the recording paper remains on the roller after the paper passes through the nip because the toner melts too much in the nip) were rated "HO". Furthermore, samples in which cold offset occurred (a phenomenon in which the toner on the recording paper is insufficiently melted through the nip, and transfers onto the fixing roller after passing through the nip without fixing to the paper) were rated "CO". The non-offset region was investigated by such a measurement method. Here, the non-offset region is defined as the temperature region rated as "A".

A method for making the un-fixed image samples is described next.

Color oil-less toner containing wax (polyester resin and styrene acrylic resin) was used as the toner. The particle diameter of the toner was 8.5 μm, and the amount of toner attached to the recording paper per unit area was 1.5 $mg/cm^2$. 65 g standard copy paper was used as the recording paper. The process speed was 120 mm/s and the experiment was performed by varying the setting for the surface temperature of the heating roller 1 (the fixing temperature) from 130° C. to 190° C. in 10° C. increments.

Figure 3:
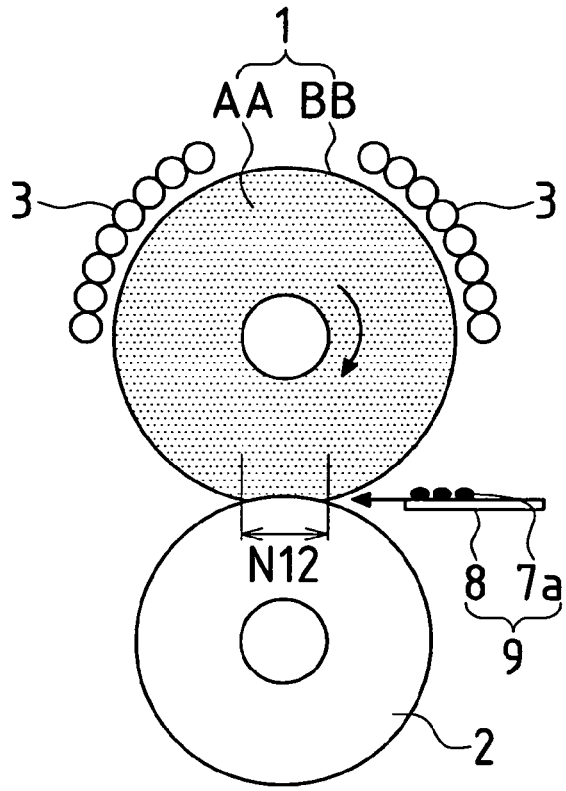
FIG. 3 is a cross-sectional overview showing a condition in which there is no gap between a cylindrical member and an elastic roller when driving the heating roller.

The results of the investigation at the conditions noted above showed that a stable release was achieved at 140° C. when the outer diameter of the elastic roller AA was 40.0 mm, that is to say, when the internal diameter difference d (internal diameter of the cylindrical member BB—outer diameter of the elastic roller AA) with the cylindrical member BB was zero (the condition shown in FIG. 3), but favorable release properties were not achieved with a temperature of 150° C. or above.

Next, when the outer diameter of the elastic roller AA was 39.0 mm, that is to say, when the internal diameter difference d was 1.0 mm, stable release was achieved from 130° C. to 170° C., but wind-up occurred at 180° C.

Figure 4:
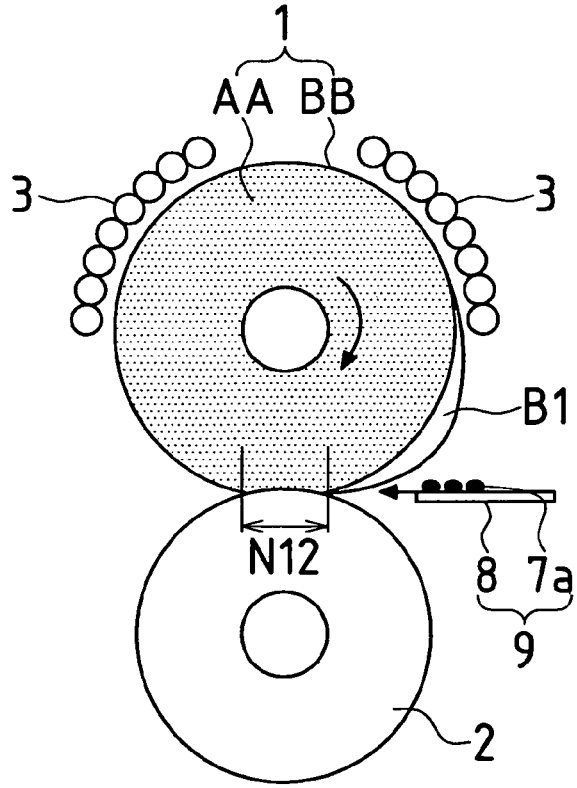
FIG. 4 is a cross-sectional overview showing a condition in which there is a suitable gap between the cylindrical member and the elastic roller when driving the heating roller. This is the cross-sectional overview of the heating roller in the fixing device shown in FIG. 2.

In a similar manner, stable release was also achieved from 130° C. to 170° C. under conditions in which the internal diameter difference d was 0.5 mm and 1.5 mm, however wind-up occurred at 180° C. A similar tendency was seen in releasability only when, as shown in FIG. 4, a deflection B1 of the cylindrical member BB created by the internal diameter difference between the cylindrical member BB and the flexible roller AA when the heating roller 1 is rotated by operating the fixing device, is generated on the paper feed side (right hand side of in FIG. 4). That is to say, the curvature of the cylindrical member BB on the paper discharge side is formed along the curvature of the elastic roller AA, and thus after fixing, the recording paper 8 releases from the heating roller 1 due to the stiffness of the recording paper 8 itself.

Next, when the outer diameter of the elastic roller was 38.0 mm, that is to say, when the internal diameter difference d with the cylindrical member BB was 2.0 mm, no favorable release properties were achieved at a temperature of 140° C. or above, as shown in Table 1 below.

Figure 5:
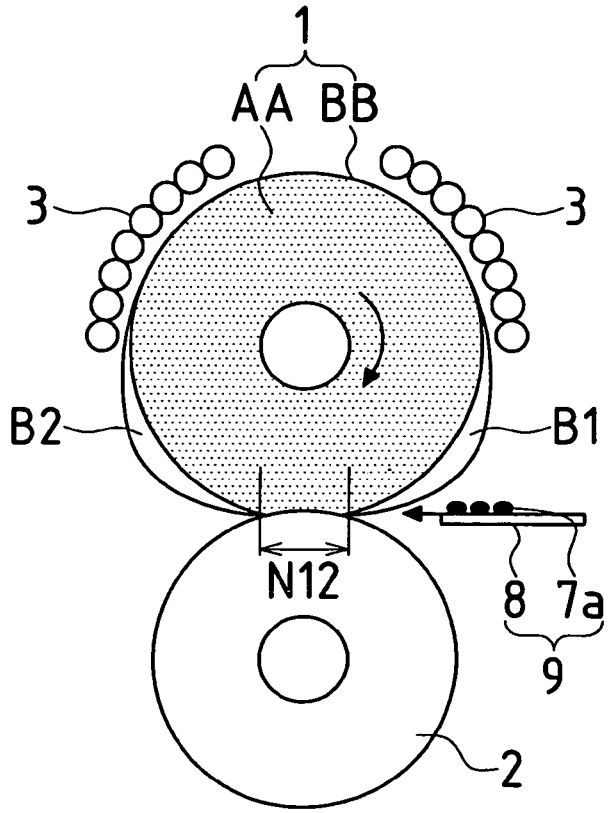
FIG. 5 is a cross-sectional overview showing a condition in which the gap between the cylindrical member and the elastic roller is too large, when driving the heating roller.

At this time, because the deflection B1 and a deflection B2 of the cylindrical member BB are created on the paper feed side (right side of FIG. 5) and the paper discharge side (left side of FIG. 5) by the internal diameter difference when rotating the heating roller as shown in FIG. 5, at the instant the recording paper 8 that is carrying the unfixed toner image exits from the nip portion N12, the recording paper 8 does not separate from the deflecting cylindrical portion BB, and so winds-up onto the heating roller 1. Thus, when deflecting of the cylindrical portion BB appears on the paper discharge side while rotating the heating roller 1, it seems that the paper is not able to release from the roller simply by its own stiffness because of the reduced curvature, and so winds up on to the heating roller 1.

From this result, the widest non-offset region is achieved when the difference d between the outer diameter of the elastic roller AA and the inner diameter of the cylindrical member BB (the inner diameter difference) is $0<d<2$ mm.

Figure 7:
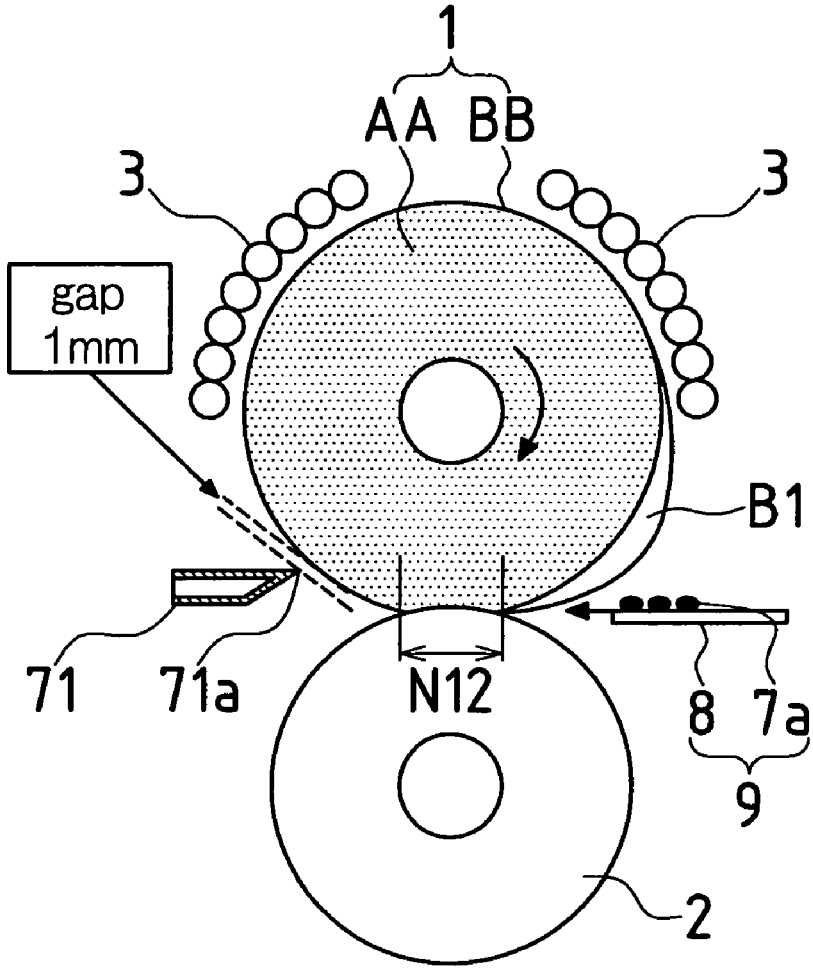
FIG. 7 is a cross-sectional overview showing a condition in which a release plate is attached in the vicinity of the heating roller.

Moreover, in the experiment described above, a similar experiment was performed in which a release plate 71, which is a member for aiding paper release, was arranged in the vicinity of the paper discharge side of the heating roller 1, as shown in FIG. 7. More specifically, the release plate 71 is arranged on the paper discharge side of the heating roller 1 to maintain a gap of 1 mm between the surface of the heating roller 1 and a tip 71*a* of the release plate 71. The tip portion of the release plate 71 is wedge-shaped, and has a form such that a leading edge of the recording paper 8 is easily caught as it exits from the region of the nip portion N12. The release plate 71 is arranged in the axial direction of the heating roller 1 (direction perpendicular to the paper surface of the diagram) at a uniform distance from the roller. In the present Working Example 1, a release plate constituted by fluorine (PTFE) coated onto a 0.2 mm thick SUS plate was employed.

As shown in Table 2 below, when the outer diameter of the elastic roller AA was 38.0 mm, that is, when the inner diameter difference was 2.0 mm, and when the outer diameter of the elastic roller AA was 40.0 mm, that is to say, when the inner diameter difference was 0 mm, the results of the releasability were not improved. However, favourable release properties were obtained at 180° C. when the inner diameter difference was 1 mm, thus expanding the non-offset region.

TABLE 1

| Internal diameter difference | 130° C. | 140° C. | 150° C. | 160° C. | 170° C. | 180° C. | 190° C. |
|---|---|---|---|---|---|---|---|
| 0 mm | CO | A | F | F | F | F | HO |
| 1.0 mm | CO | A | A | A | A | B | HO |
| 2.0 mm | CO | F | F | F | F | F | HO |

TABLE 2

| Internal diameter difference | 130° C. | 140° C. | 150° C. | 160° C. | 170° C. | 180° C. | 190° C. |
|---|---|---|---|---|---|---|---|
| 0 mm | CO | A | F | F | F | F | HO |
| 1.0 mm | CO | A | A | A | A | A | HO |
| 2.0 mm | CO | F | F | F | F | F | HO |

That is to say, the non-offset region can be enlarged because the recording paper that is discharged with a tendency to wind up onto the heating roller 1 can be forcibly separated by the release plate 71, by arranging the release plate 71 in a position proximate to the vicinity of the heating roller 1. Furthermore, the release plate 71 does not scratch the heating roller 1 because the release plate 71 is not in contact with the heating roller 1, thus maintaining the durability of the heating roller 1. On the other hand, when the internal diameter difference is 0 mm or 2 mm, the fixing region is not enlarged by use of the release plate 71 (that is to say, even if an attempt is made to forcibly release recording paper that has a tendency to wind up onto the roll, the recording paper still winds up onto the roll without the release plate 71 that is arranged in a proximate position being able to catch the leading edge of the paper). Even assuming that the recording paper could be forcibly separated, it would be necessary for the tip 71*a* of the release plate 71 to make contact with the heating roller 1, thus causing problems with durability.

When the drift prevention guide members 60 for preventing meandering, as described above, were provided, drift of the cylindrical member BB was prevented without problem when the inner diameter difference was in the range of $0<d<2$ mm, however it was difficult to prevent the cylindrical member BB from meandering when the inner diameter difference exceeded 2 mm.

WORKING EXAMPLE 2

An experiment was performed to evaluate the releasability of a fixing device having the above-noted configuration, wherein the conditions of the elastic roller AA were the same, and wherein the material of the heat generating layer 13 of the cylindrical member BB was altered from polyimide to nickel (thickness of 40 μm and 30 μm) (however the elastic layer 14 and the release layer 15 were kept the same). The experimental method was the same as in Working Example 1 and is thus omitted.

When the heat generating layer 13 was nickel with a thickness of 40 μm, the surface hardness t1 of the heating roller 1 was 75° (Asker C), and the hardness differential t3 with the surface hardness (t2=25°) of the elastic roller AA was 50°. On the other hand, the result of a similar measurement when the thickness of the nickel was 30 μm was the surface hardness t1 of the heating roller 1 was 70°, and the hardness differential t3 was 45°. The releasability results taken at this time are shown in Table 3 below.

TABLE 3

| heat gen. layer material | hard. diff. | 130° C. | 140° C. | 150° C. | 160° C. | 170° C. | 180° C. | 190° C. |
|---|---|---|---|---|---|---|---|---|
| polyimide | 40 | CO | A | A | A | A | B | HO |
| nickel 30 μm | 45 | CO | A | A | A | F | F | HO |
| nickel 40 μm | 50 | CO | B | F | F | F | F | HO |

Although there was no non-offset region when the thickness of the nickel was 40 μm, the non-offset region expanded to 140° C. to 160° C. when the nickel thickness was 30 μm. When the material was altered to polyimide in order to reduce the surface hardness differential, the surface hardness differential t3 was 40°, and the non-offset region expanded to the range of 140° C. to 170° C.

Since the shape of the nip portion N12 that is formed by pressing the heating roller 1 onto the pressuring roller 2 can also be directed down by reducing the surface hardness of the heating roller 1 as much as possible, this result is due to an increase in the self releasability. The surface hardness of the heating roller 1 is greatly influenced by the surface hardness of the inner elastic thermal insulation layer 12. However, if the surface hardness differential between the surface hardness of the heating roller 1 and the elastic roller AA is 50° or greater, then since the cylindrical member BB itself will be too hard, even if the elastic thermal insulation layer 12 has low hardness, for example, as for the shape of the nip portion N12, the downward facing nip will weaken because the surface hardness of the heating roller 1 will increase, and it becomes difficult to maintain the releasability of the paper.

From this, it is preferable that in the relationship between the surface hardness t2 of the elastic roller AA and the surface hardness differential t3 with the surface hardness t1 of the heating roller 1, that $0°<t3<50°$. This is more preferably $0°<t3\leqq 45°$, and is even more preferably $0°<t3\leqq 40°$.

WORKING EXAMPLE 3

In the present Working Example 3, an experiment was performed with respect to warm-up time, using the image forming apparatus (an example embodiment) provided with a heating device containing an example embodiment of the heating roller of the present invention (constituted by the cylindrical member and the elastic roller, which are capable of separating, wherein a gap (air layer) is formed between the cylindrical member and the elastic roller), and an image forming apparatus (comparative example) that is provided with a heating device containing a conventional heating roller (in which the cylindrical member and the elastic roller are a single piece that cannot be separated).

In the experiment, the time (s) taken for the surface of the heating roller to achieve a temperature of 170° C. from room temperature was measured under the following conditions:

Measured Conditions (1) Power Supply: 1100 W (2) Rotational Speed: 117 mm/s (3) Elastic Roller: External Diameter: Ø 39 mm (hardness: 25°)

(4) Pressuring Roller

External Diameter: Ø 30 mm

Aluminium metal core/Silicone rubber layer 0.5 mm/PFA tube, 30 μm (5) Cylindrical Member Heat generating layer: Polyimide base with dispersed silver, 80 μm.

Elastic layer: Silicone rubber, 250 μm

Releasing layer: PFA tube, 20 μm

Internal Diameter: Example Embodiment, Ø 40 mm/Comparative Example, Ø 39 mm

By measuring the warm-up time in accordance with the measurement conditions described above, an example embodiment gave a result of 27 s, and the Comparative Example gave a result of 35 s.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A heating roller, comprising:

an elastic roller comprising an elastic thermal insulation layer above a metal core; and a flexible tube-shaped member comprising a releasing layer above a thin-film base material that is configured to generate heat or to be heated;

wherein said heating roller comprises a paper feed side;

wherein said heating roller is configured to be pressed against a pressurizing roller such that, when the heating roller is in a state of being pressed against said pressurizing roller, a gap exists between the elastic roller and the tube-shaped member on said paper feed side adjacent the area where said heating roller is pressed against said pressurizing roller.

2. A heating roller, comprising:

an elastic roller comprising an elastic thermal insulation layer above a metal core; and a flexible tube-shaped member comprising at least a releasing layer above a thin-film base material that is configured to generate heat or to be heated, wherein the elastic roller and the tube-shaped member are separable;

wherein a slight gap exists between the elastic roller and the tube-shaped member;

wherein an inner diameter difference d(=i.e., Ø2−Ø1) between the outer diameter of the elastic roller (Ø1) and the inner diameter of the tube-shaped member (Ø2) satisfies the expression:

$$0<d<2 \text{ mm}.$$

3. The heating roller according to claim 1, wherein a hardness differential between the surface hardness of the tube-shaped member and the surface hardness of the elastic roller is such that a nip portion of said heating roller has a shape that faces downward.

4. The heating roller according to claim 3, wherein the tube-shaped member comprises resin.

5. A heating roller, comprising:

an elastic roller comprising an elastic thermal insulation layer above a metal core;

and a flexible tube-shaped member comprising at least a releasing layer above a thin-film base material that is configured to generate heat or to be heated, wherein the elastic roller and the tube-shaped member are seperable;

wherein a slight gap exists between the elastic roller and the tube-shaped member;

wherein a hardness differential between the surface hardness of the tube-shaped member and the surface hardness of the elastic roller is such that, when the heating roller is in a state of being pressed against a pressuring roller, a resulting nip portion has a shape that is oriented downward; and wherein the surface hardness differential t3(=t1−t2) between the surface hardness t1 of the heating roller and the surface hardness t2 of the elastic roller satisfies the expression: $0° \leqq t3 < 50°$ according to an Asker C durometer.

6. A heating roller, comprising:

an elastic roller comprising an elastic thermal insulation layer above a metal core;

and a flexible tube-shaped member comprising at least a releasing layer above a thin-film base material that is configured to generate heat or to be heated, wherein the elastic roller and the tube-shaped member are seperable;

wherein a slight gap exists between the elastic roller and the tube-shaped member;

wherein a hardness differential between the surface hardness of the tube-shaped member and the surface hardness of the elastic roller is such that, when the heating roller is in a state of being pressed against a pressuring roller, a resulting nip portion has a shape that is oriented downward;

wherein the tube-shaped member comprises resin; and wherein the surface hardness differential t3(=t1−t2) between the surface hardness t1 of the heating roller and the surface hardness t2 of the elastic roller satisfies the expression: $0° \leqq t3 < 50°$ according to an Asker C durometer.

7. A heating device, comprising at least:

a heating rotating member comprising an elastic roller comprising an elastic thermal insulation layer above a metal core, and a flexible tube-shaped member comprising a releasing layer above a thin-film base material that is configured to generate heat or to be heated;

a pressuring member configured to be pressed against the heating rotating member such that, when the pressuring member is in a state of being pressed against said heating rotating member, a gap exists between the elastic roller and the tube-shaped member on a paper feed side adjacent the area where said pressuring member is pressed against said heating rotating member;

wherein the heating device is configured to heat the heating rotating member by way of a heat source external to the heating rotating member; and wherein an unfixed toner image is fixed in a nip portion that is formed by the heating rotating member and the pressuring member being pressed together.

8. The heating device according to claim 7, wherein the relationship of the surface hardness of an elastic thermal insulation layer of the heating rotating member to the surface hardness of the pressuring member is such that a nip portion has a shape that faces downward.

9. The heating device according to claim 8, wherein the surface hardness of the elastic thermal insulation layer is lower than the surface hardness of the pressuring member.

10. The heating device according to claim 7, wherein the tube-shaped member comprises a heat generating layer, an elastic layer, and a releasing layer.

11. The heating device according to claim 7, wherein a recording paper release aiding member is positioned on a paper discharge side of the heating rotating member, proximate to the heating rotating member.

12. The heating device according to claim 10, wherein a recording paper release aiding member is positioned on a paper discharge side of the heating rotating member, proximate to the heating rotating member.

13. The heating device according to claim 7, wherein said heating rotating member comprises a first drift prevention guide located at one end thereof and a second drift prevention guide located at a second end thereof, and wherein said drift prevention guides are configured to prevent the tube-shaped member from meandering.

14. The heating device according to claim 10, wherein said heating rotating member comprises a first drift prevention guide located at one end thereof and a second drift prevention guide located at a second end thereon, and wherein said drift prevention guides are configured to prevent the tube-shaped member from meandering.

15. The heating device according to claim 11, wherein said heating rotating member comprises a first drift prevention guide located at one end thereof and a second drift prevention guide located at a second end thereon, and wherein said drift prevention guides are configured to prevent the tube-shaped member from meandering.

16. The heating device according to claim 12, wherein said heating rotating member comprises a first drift prevention guide located at one end thereof and a second drift prevention guide located at a second end thereon, and wherein said drift prevention guides are configured to prevent the tube-shaped member from meandering.

17. The heating device according to claim 7, wherein the heating rotating member is configured to be heated by application of an alternating magnetic field to the heating rotating member to generate an induction electric current.

18. An image forming apparatus comprising a heating roller comprising an elastic roller comprising an elastic thermal insulation layer above a metal core; and a flexible tube-shaped member comprising at least a releasing layer above a thin-film base material that is configured to generate heat or to be heated;

wherein the elastic roller and the tube-shaped member are separable;

wherein a slight gap exists between the elastic roller and the tube-shaped member;

wherein a hardness differential between the surface hardness of the tube-shaped member and the surface hardness of the elastic roller is such that, when the heating roller is in a state of being pressed against a pressuring roller, a resulting nip portion has a shape that is oriented downward; and wherein the surface hardness differential $t3(=t1-t2)$ between the surface hardness $t1$ of the heating roller and the surface hardness $t2$ of the elastic roller satisfies the expression: $0° \leqq t3 < 50°$ according to an Asker C durometer.

19. A heating device, comprising at least:

a heating rotating member comprising an elastic roller comprising an elastic thermal insulation layer above a metal core and a flexible tube-shaped member having at least a releasing layer above a thin-film base material that is configured to generate heat or to be heated;

wherein said heating rotating member is configured to be pressed against a pressurizing roller such that, when the heating rotating member is in a state of being pressed against said pressurizing roller, a gap exists between the elastic roller and the tube-shaped member on a paper feed side adjacent the area where said heating rotating member is pressed against said pressurizing roller.

20. The heating device of claim 19, wherein a recording paper release aiding member is positioned on a paper discharge side of the heating rotating member, proximate to the heating rotating member.

21. The heating roller of claim 1, further comprising a first drift prevention guide at one end of said heating roller and a second drift prevention guide at a second end of said heating roller.

22. The heating roller of claim 21, wherein said first drift prevention guide is located at one end of said elastic roller and said second drift prevention guide is located at a second end of said elastic roller.

23. The heating roller of claim 1, wherein said flexible tube-shaped member is configured to be generate heat or to be heated by cooperation with a source external to the flexible tube-shaped member.

24. An image forming apparatus comprising:

a heating rotating member, comprising an elastic roller comprising an elastic thermal insulation layer above a metal core, and a flexible tube-shaped member comprising a releasing layer above a thin-film base material that is configured to generate heat or to be heated;

wherein said heating rotating member comprises a paper feed side;

wherein said heating rotating member is configured to be pressed against a pressurizing roller such that, when the heating rotating member is in a state of being pressed against said pressurizing roller, a gap exists between the elastic roller and the tube-shaped member on said paper feed side adjacent the area where said heating rotating member is pressed against said pressurizing roller.

25. The image forming apparatus of claim 18, wherein the tube-shaped member comprises resin.

* * * * *